US005915827A

United States Patent [19]

Wang

[11] Patent Number: 5,915,827

[45] Date of Patent: Jun. 29, 1999

[54] DECORATIVE LIGHT CURTAIN FORMED BY MULTIPLE LIGHT STRINGS

[76] Inventor: Jessica Wang, 4F-3,No. 77,Sec.2,Tun Hwa South Road, Taipei, Taiwan

[21] Appl. No.: 08/968,397

[22] Filed: Nov. 12, 1997

[51] Int. Cl.[6] ..... F21P 1/00

[52] U.S. Cl. ..... 362/252; 362/249; 362/391; 362/396

[58] Field of Search ..... 362/249, 250, 362/252, 391, 806, 396

[56] References Cited

U.S. PATENT DOCUMENTS 4,228,486 10/1980 Matsuya ..... 362/252 X 5,150,964 9/1992 Tsui ..... 362/252 X

*Primary Examiner*—Stephen Husar

*Attorney, Agent, or Firm*—Pro-Techtor International Services

[57] ABSTRACT

A decorative light curtain formed by multiple branched light strings is disclosed. The decorative light curtain includes a light string supporting trunk and a plurality of branched light strings suspended from the light string supporting trunk. Each of the branched light strings includes a plurality of bulb stands arranged on the light strings. Each of the bulb stands is provided with a coupling structure for joining one of the bulb stands or connecting cord of the light strings adjacent to it.

4 Claims, 6 Drawing Sheets

DECORATIVE LIGHT CURTAIN FORMED BY MULTIPLE LIGHT STRINGS

BACKGROUND OF THE INVENTION

1. Field of the Invention

The present invention relates to an improved Christmas light string, and more particularly to a decorative light curtain formed by a number of branched Christmas light strings.

2. Description of the Prior Art

The conventional Christmas tree light string is generally composed of an electric plug 1, an electric receptacle 2, and a number of standard bulb stands 3, as shown in FIG. 1. Each of the standard bulb stands 3 is designed to receive a miniature light bulb 4 thereon.

Typically, the light string includes a first electric power cord L1, a second electric power cord L2, and a connecting cord L3. The first electric power cord L1 and the second electric power cord L2 are used to supply an AC electric power source, such as AC 110 V via the electric plug 1 to the light string. The electric receptacle 2 serves as an extended electric power receptacle used to be plugged by the an electric plug (not shown) of the other light string so as to form an extendable long light string. The connecting cord L3 is used to electrically connecting the light bulbs to form a series connected light string.

However, this conventional type of Christmas light string merely is a simple light string, and therefore has disadvantage of simple decorative feature.

Various Christmas light strings with more decorative features are developed in the prior art. An example of a prior art Christmas light string is disclosed in U.S. Pat. No. 4,073,564, issued Feb. 14, 1978, issued to Davis, Jr., et. al., entitled "Christmas tree series light string". This prior art invention provides a series string of Christmas tree lights wherein the series loop may be temporarily opened by separating the plug connector to permit untangling of the string and thereafter the loop restored for operatively connecting with a power source by again plugging together the halves of the connector.

Another example of the prior art Christmas light string is disclosed in U.S. Pat. No. 4,542,446 issued Sep. 17, 1985, issued to Shiff, Max J., et. al., entitle "Decorative ornament having garland and a light string". This prior art patent provides a decorative ornament that includes a garland, having a center cord and a tinsel strip wound around the center cord. The tinsel strip is divided into a plurality of narrow strands. The invention further includes light string, having an electric cord and a plurality of lights connected together by the electric cord. The light string is wound around the center cord of the garland in a direction opposite to the direction the tinsel strip is wound around the center cord.

Another example of the prior art Christmas light string is disclosed in U.S. Design Pat. No. 355,268 issued Feb. 7, 1995, issued to Openiano., et. al., entitle "Multi-branched Christmas light cluster". This prior art patent provides a design for a multi-branched Christmas light cluster.

However, these prior art patents still has disadvantage of simple decorative feature.

SUMMARY OF THE INVENTION

For obviating the aforementioned drawback found in the conventional light string, it is the primary object of the present invention to provide an improved Christmas light string capable of presenting versatile visible features.

The other object of the present invention is to provide a decorative light curtain formed by multiple branched light strings. The decorative light curtain includes a light string supporting trunk and a plurality of branched light strings suspended from the light string supporting trunk. Each of the branched light strings includes a plurality of bulb stands arranged on the light strings. Each of the bulb stands is provided with a coupling structure for joining one of the bulb stands or connecting cord of the light strings adjacent to it. So, the light curtain of the present invention may be presented in various visible forms. Particularly, the present invention may be in a form of netted light curtain.

In order that the present invention may more readily be understood, the following description is given, merely be way of example, reference being made to the accompanying drawings, wherein:

DETAIL DESCRIPTION OF THE PREFERRED EMBODIMENT

The present invention relates to a decorative light curtain formed by a number of Christmas light strings. Reference will now be made in detail to the preferred embodiment of the present invention, examples of which are illustrated in the accompanying drawings. Wherever possible, the same reference numbers will be used throughout the drawings to refer to the same or like parts.

Figure 1:
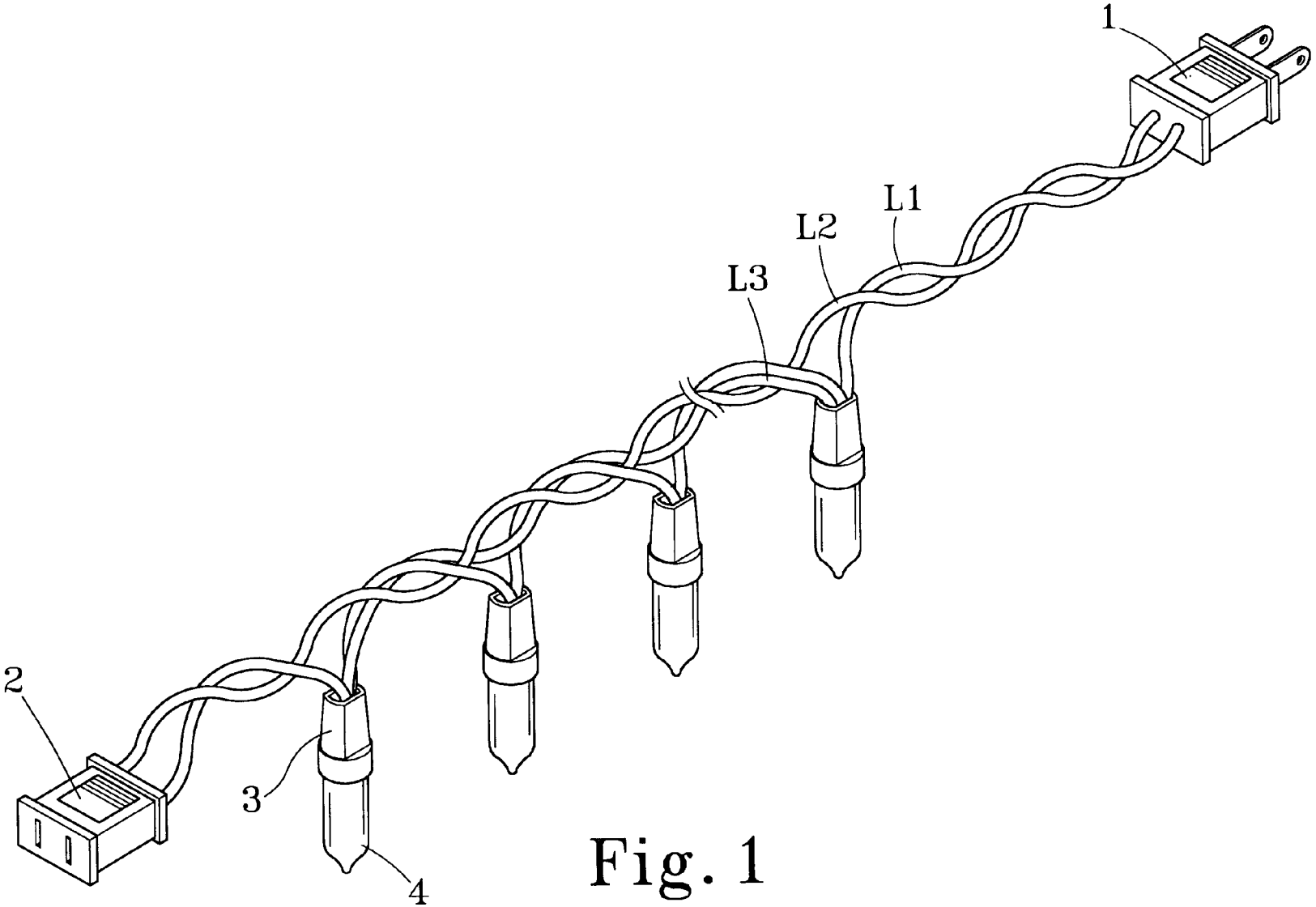
FIG. 1 is a perspective view showing a prior art Christmas light string.
Figure 2:
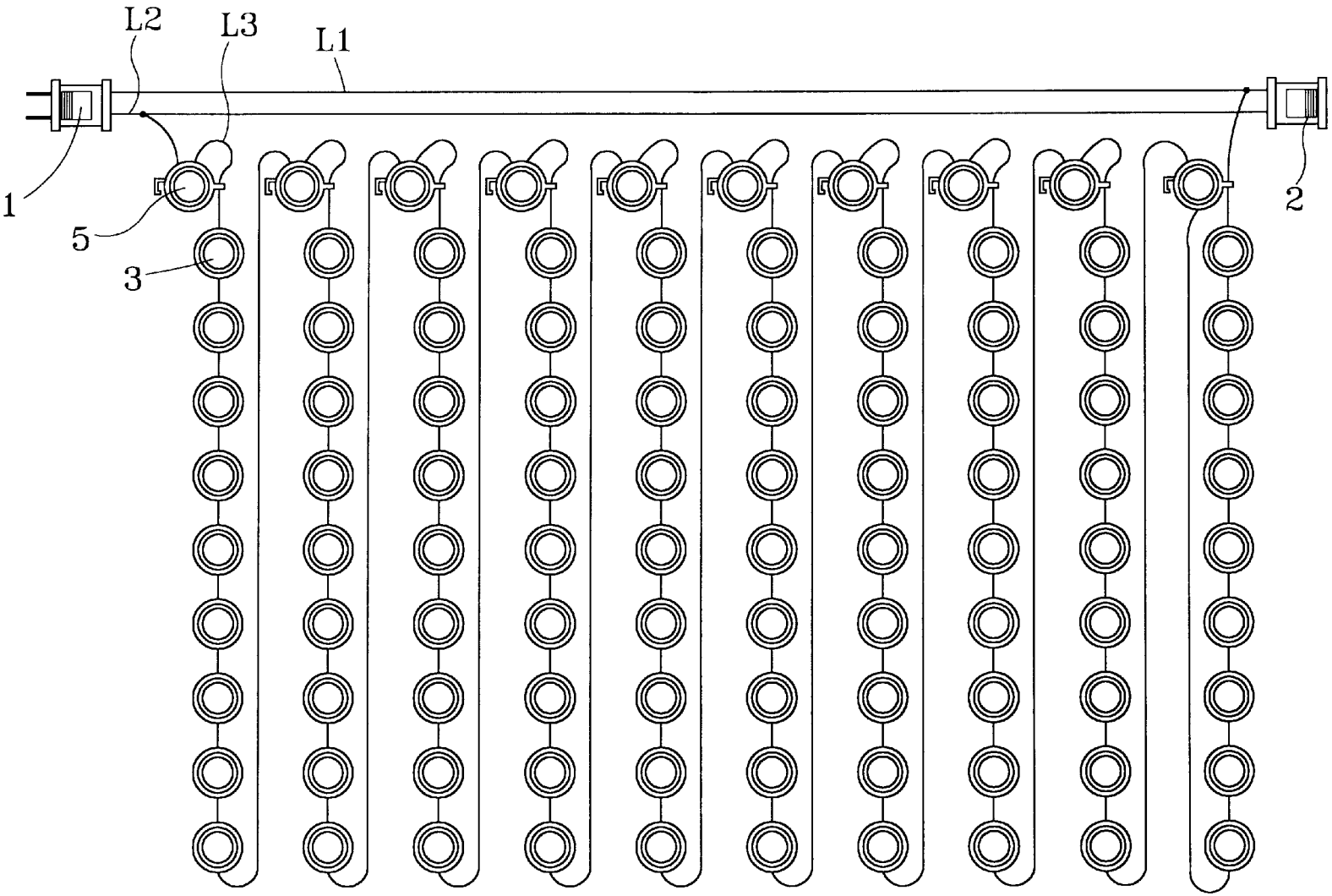
FIG. 2 is a schematic circuit connection diagram of the light curtain in accordance with the first embodiment of the present invention.

Referring to FIG. 2, there is shown a schematic circuit diagram of the decorative light curtain in accordance with the first embodiment of the present invention. The decorative light string includes an electric plug 1, an electric receptacle 2, a first electric power cord L1, a second electric power cord L2, and a number of branched light strings.

The light strings are electrically connected in series by connecting cords L3 to form a long light string. One end of the long light string is connected to the first power cord L1, and the other end of the long light string is connected to the second power cord L2. The electric plug 1 may be plugged into an electric receptacle (not shown) to supplying an AC power source, such as AC 110 V, to the long light string via the first electric power cord L1 and the second electric power cord L2.

In a practical Christmas light sting product available in the commercial market, the first electric power cord L1, the second electric power cord L2, and the adjacent connecting cords L3 are normally knitted together as a light string supporting trunk. So, all the branched light strings are suspended from the center trunk.

Figure 6:
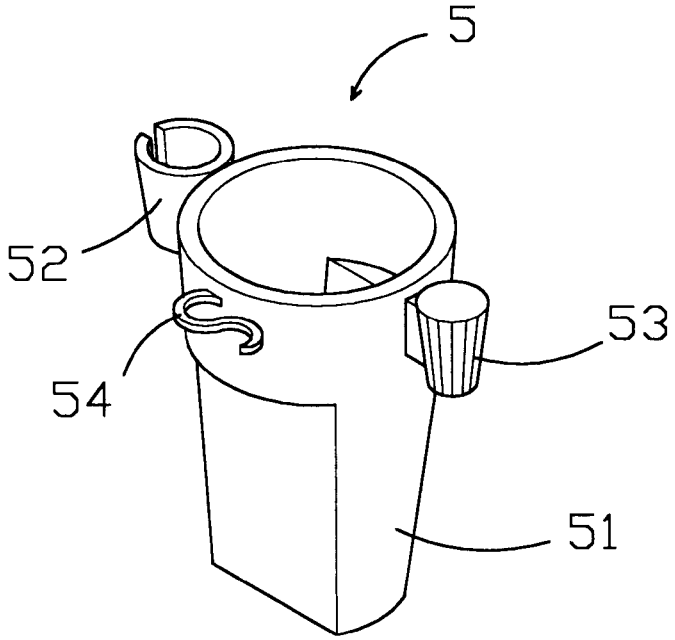
FIG. 6 is a perspective view of the improved bulb stand of the present invention.

In this embodiment, each of the light strings includes a combinable bulb stand 5 and a number of standard bulb stands 3. The structure of the standard bulb stand is identical to that of the bulb stand of the known Christmas tree light. The combinable bulb stand 5 is provided with a coupling structure capable of coupling the connecting cord adjacent to it, as shown in the drawing. In such an arrangement, a multi-branched decorative light string is formed. The coupling structure of the combinable bulb stand 5 is shown in FIG. 6 and will be described in detail later.

Figure 3:
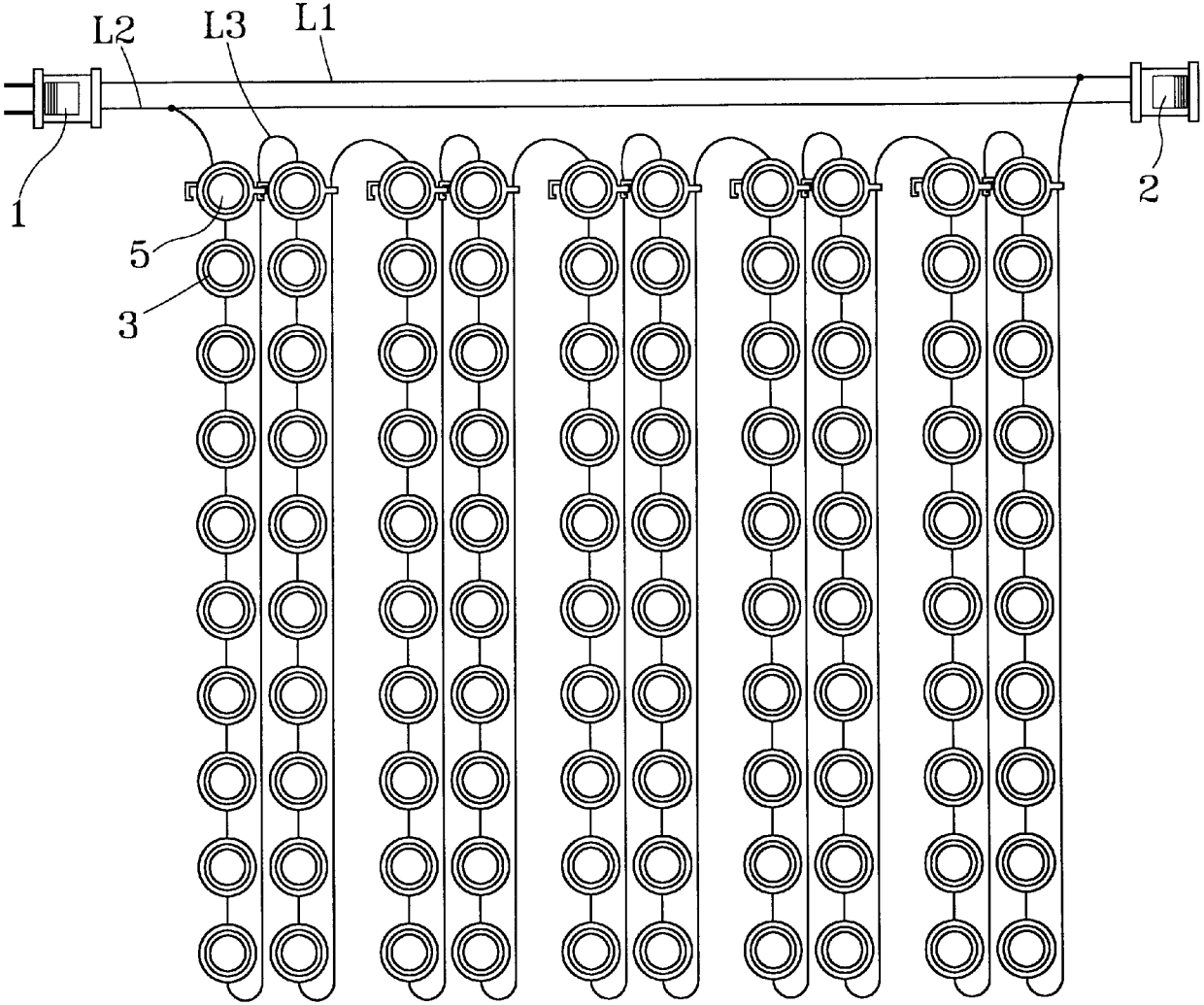
FIG. 3 is a schematic circuit connection diagram of the light curtain in accordance with the second embodiment of the present invention.

FIG. 3 is a schematic circuit diagram showing the decorative light curtain in accordance with the second embodiment of the present invention. Similar to the first embodiment of the present invention as described above, the decorative light curtain of this embodiment includes an electric plug 1, an electric receptacle 2, a first electric power cord L1, a second electric power cord L2, and a number of branched light strings which are electrically connected in series by connecting cords L3.

In this embodiment, each of the light strings includes a combinable bulb stand 5 and a number of standard bulb stands 3, and preferably the combinable bulb stand 5 is arranged on the upper position of the light string. So, two adjacent light strings may be joined together via its coupling structure so as to form a multi-branched decorative light string, as shown in the drawing.

Figure 4:
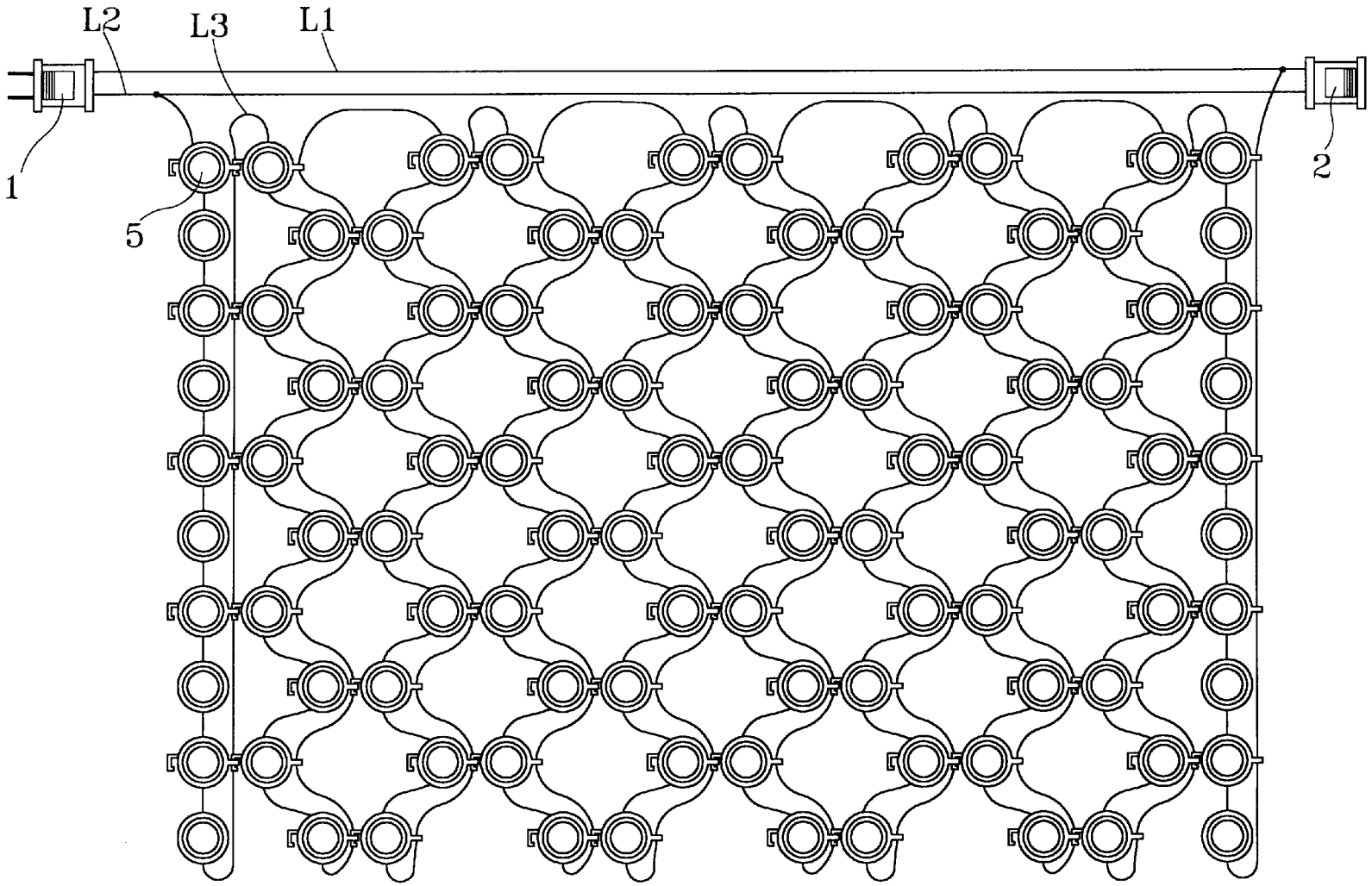
FIG. 4 is a schematic circuit connection diagram of the light curtain in accordance with the third embodiment of the present invention.

FIG. 4 is a schematic circuit diagram showing the decorative light curtain in accordance with the third embodiment of the present invention. Similar to the previous embodiments of the present invention as described above, the decorative light curtain of this embodiment includes an electric plug 1, an electric receptacle 2, a first electric power cord L1, a second electric power cord L2, a number of connecting cord L3, and a number of branched light strings.

In this embodiment, each of the light strings includes a number of combinable bulb stands 5 and a number of standard bulb stands 3. The combinable bulb stands 5 of adjacent light strings may be jointed together via its coupling structure so as to form a netted decorative light string, as shown in the drawing.

Figure 5:
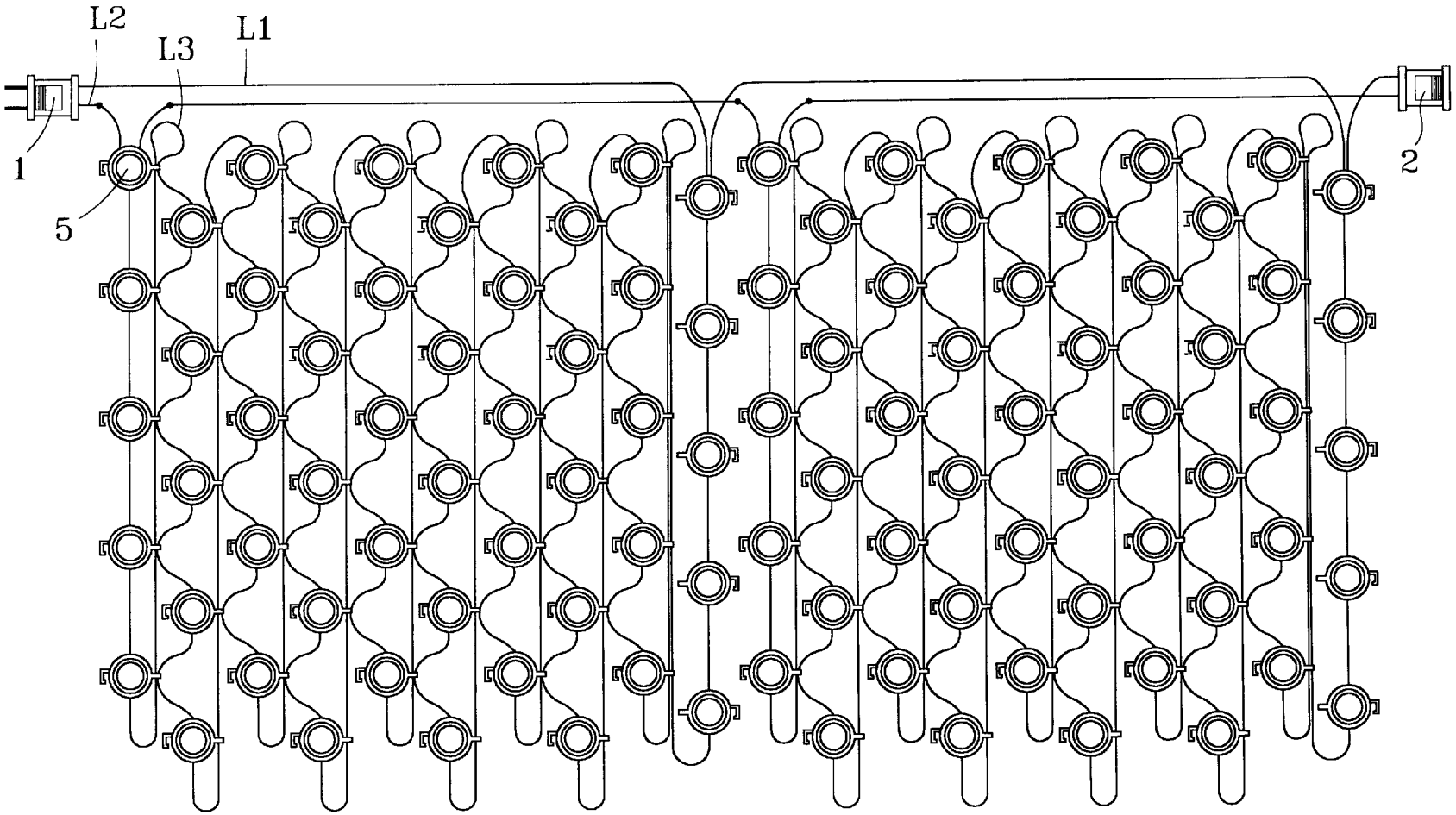
FIG. 5 is a schematic circuit connection diagram of the light curtain in accordance with the fifth embodiment of the present invention.

FIG. 5 is a schematic circuit diagram showing the decorative light curtain in accordance with the fifth embodiment of the present invention. Similar to the previous embodiments of the present invention as described above, the decorative light curtain of this embodiment includes an electric plug 1, an electric receptacle 2, a first electric power cord L1, a second electric power cord L2, a number of connecting cord L3, and a number of branched light strings.

In this embodiment, each of the light strings includes a number of combinable bulb stands 5. The combinable bulb stands 5 of adjacent light strings are particularly arranged in an interlaced form. So, each of the combinable bulb stands of a light string may hook the faced connecting cord of the adjacent light strings via its coupling structure to form a netted decorative light string, as shown in the drawing.

Figure 7:
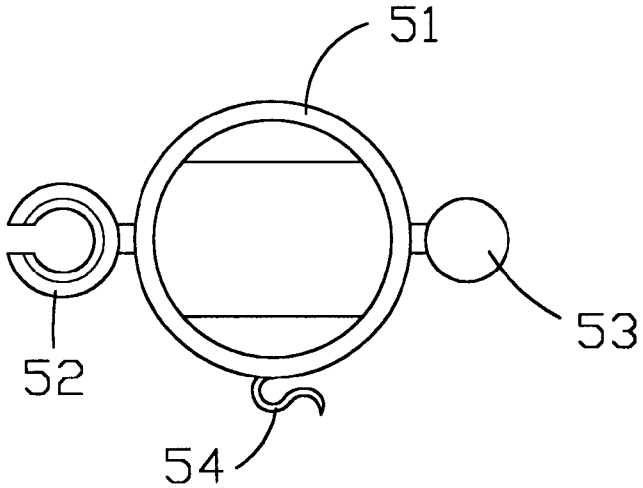
FIG. 7 is a top plane view of the improved bulb stand of FIG. 6.

FIG. 6 is a perspective view showing the structure of the combinable bulb stand of the present invention, which is suitable to be used in the various embodiments previously described above. FIG. 7 is a top plan view of the combinable bulb stand of FIG. 6. As shown in the drawing, the combinable bulb stand of the present invention is provided with a coupling structure for joining the other combinable bulb stand or connecting cord of adjacent light strings. The coupling structure of the combinable bulb stand 5 comprises a base portion 51 for receiving a light bulb thereon, a C-shaped hooking member 52 formed on the first side wall of the base portion 51, and an inserting member 53 formed on the second side wall of the base portion 51. So, the combinable bulb stand 5 of the present invention may join the other combinable bulb stand together by means of the C-shaped hooking member 52 and the inserting member 53.

In addition, the coupling structure of the combinable bulb stand further comprises a S-shaped hooking member 54 on a side wall of the base portion 51. So, the combinable bulb stand 5 of the present invention may hook the connecting cord of adjacent light strings by means of the S-shaped hooking member 54.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. A decorative light curtain formed by multiple branched light strings, comprising:

a light string supporting trunk comprising a first electric power cord, a second electric power cord, and connecting cords;

a plurality of branched light strings suspended from the light string supporting trunk; and a plurality of bulb stands arranged on the light strings, the bulb stands being electrically connected in series by the connecting cords and then connected across the first electric power cord and the second electric power cord;

wherein each of the bulb stands is provided with a coupling structure for joining one bulb stand of light strings adjacent to it.

2. The light curtain as claimed in claim 1, wherein the coupling structure of the bulb stand comprises:

a base portion for receiving a light bulb thereon, having a first side wall and a second side wall;

a C-shaped hooking member formed on the first side wall of the base portion; and an inserting member formed on the second side wall of the base portion.

3. A decorative light curtain formed by multiple branched light strings, comprising:

a light string supporting trunk comprising a first electric power cord, a second electric power cord, and connecting cords;

a plurality of branched light strings suspended from the light string supporting trunk; and a plurality of bulb stands arranged on the light strings, the bulb stands being electrically connected in series by the connecting cords and then connected across the first electric power cord and the second electric power cord;

wherein each of the bulb stands is provided with a coupling structure for hooking the connecting cord of light strings adjacent to it.

4. The light curtain as claimed in claim 3, wherein the coupling structure of the bulb stand comprises:

a base portion for receiving a light bulb thereon, having a first side wall; and a S-shaped hooking member formed on the first side wall of the base portion.

* * * * *